US005677691A

United States Patent [19]

Hosticka et al.

[11] Patent Number: 5,677,691

[45] Date of Patent: Oct. 14, 1997

[54] CONFIGURABLE ANALOG AND DIGITAL ARRAY

[75] Inventors: Bedrich Hosticka, Duisburg; Werner Schardein, Kamp-Lintfort; Berthold Weghaus, Dinslaken, all of Germany

[73] Assignee: Fraunhofer-Gesellschaft zur Forderung der Angewandten Forschung e.v., Munich, Germany

[21] Appl. No.: 569,099

[22] PCT Filed: Jun. 25, 1993

[86] PCT No.: PCT/EP93/01637

§ 371 Date: May 24, 1996

§ 102(e) Date: May 24, 1996

[87] PCT Pub. No.: WO95/00921

PCT Pub. Date: Jan. 5, 1995

[51] Int. Cl.[6] ..... H03M 1/00

[52] U.S. Cl. ..... 341/155; 326/39; 341/144

[58] Field of Search ..... 341/155, 144; 326/39, 41

[56] References Cited

U.S. PATENT DOCUMENTS 4,847,612 7/1989 Kaplinsky .
5,338,984 8/1994 Sutherland ..... 326/41
5,426,379 6/1995 Trimburger ..... 326/39

FOREIGN PATENT DOCUMENTS

A-0322382 6/1989 European Pat. Off. .
A-0420390 4/1991 European Pat. Off. .

OTHER PUBLICATIONS

Preiss, "Digitales und Analoges auf einem Chip", Elektronik, 36:(0):135–138 (May 15, 1987).
Laes et al., "Analog–digital Technologies for Mixed–Signal Processing", IEEE Micro, 12(4):34–42 (Aug. 1992).

*Primary Examiner*—Brian K. Young
*Attorney, Agent, or Firm*—Wolf, Greenfield & Sacks, PC

[57] ABSTRACT

A configurable analog and digital array is realized in a hierarchical structure on at least two levels. It comprises at least two first-order matrix arrays, each of said matrix arrays including a plurality of basic elements which are arranged in rows and/or columns and at least part of which are analog basic elements, and a first switch matrix for controllably interconnecting the signal inputs and the signal outputs of the basic elements and for connecting said basic elements to matrix inputs and matrix outputs, as well as at least one second-order matrix array having a second switch matrix for controllably interconnecting the matrix inputs and the matrix outputs of the first-order matrix arrays and for controllably connecting said matrix arrays to array inputs and array outputs.

14 Claims, 8 Drawing Sheets

CONFIGURABLE ANALOG AND DIGITAL ARRAY

FIELD OF THE INVENTION

The present invention refers to a configurable analog and digital array. In other words, the subject matter of the present invention refers to a configurable analog/digital modular array.

DESCRIPTION OF THE PRIOR ART

User-programmable circuits in the form of configurable arrays have been known for a number of years. The user-programmable circuits which are normally available on the market are constructed as configurable digital arrays, i.e. such user-programmable circuits predominantly cover the field of digital use. Such digital, user-programmable circuits have in common that a plurality of cells is provided at gate level or at register level, said cells being adapted to be programmed by the user and to be variably interconnected via prefabricated connection paths.

A special problem arising in connection with such user-programmable circuits is the problem of deciding which module is the "correct" module for the respective case of use, since the systems vary widely and since a changeover from one system to the next is only possible with difficulties.

Frequently, such user-programmable circuits are only used for examining a circuit design; in this case, it will be necessary to convert said circuit design into a so-called "full custom IC" when the final version of the circuit in question has been determined. When the prototype in question consists of several different modules, such a conversion is normally not easily possible and often it will even necessitate a socalled redesign.

In the analog field, an adequate counterpart which would be adapted to be used approximately as universally as user-programmable digital circuits in the form of configurable digital arrays have not been constructed up to now. There are only some special modules, such as filters, which can be programmed or optimized by the user by means of adequate connection. Furthermore, there are integrated arrays with analog components or cells for user-specific wiring. This wiring must be provided by the manufacturer via an aluminum mask and can, consequently, not be carried out by the customer himself. European patent application EP-0499383A2 shows a user-programmable integrated circuit with an analog section with user-configurable analog circuit modules, a digital section with user-configurable digital circuit modules, and an interface section with user-configurable interface circuits for analog/digital signal conversion and for digital/analog signal conversion, as well as a user-configurable connection and input/output architecture. The networking of the elements which can be effected by means of such a circuit is very limited. A feedback between circuit elements is, for example, not possible. In this known circuit there is only multiplexing of existing basic blocks and signal paths, which can only be modified within close limits. The programmability and controllability of the known circuit is provided by connecting fixed basic elements to other components, as can be seen e.g. in FIGS. *3a*, *3b* of this publication. Resistors and capacitors, for example, can selectively be connected to existing circuit blocks. A hierarchical structuring and organization permitting the construction of completed analog subsystems for subsequent configuration within a complete system is not possible when this known technology is used.

DE-3417670A1 shows a programmable analog circuit in the form of a programmable filter in the case of which a number of filter modules, an attenuator and a separation amplifier can be interconnected in a user-programmable manner. However, also this programmable analog circuit permits only a very limited variation of a fixedly predetermined basic circuit structure.

DE-3615981A1 discloses a system for a parameter-programmable processing of audio signals in combination with a programmable switch matrix, which is used in the field of analog and digital processing of audio signals. This system can, however, not be implemented at chip level, but only at printed circuit board level.

U.S. Pat. No. 4,847,612 shows a configurable array comprising at least two first-order matrix arrays, which include a plurality of basic elements arranged in rows and/or columns and a first switch matrix, and at least one second-order matrix array, which includes a second switch matrix connecting said at least two first-order matrix arrays, all the basic elements of said array being digital and the outputs being coupled via the first-order matrix arrays.

The publication E. Preiss, "Digitales und Analoges auf einem Chip", Elektronik, Vol. 36, No. 10, May 15, 1995, Munich, describes a mixed analog/digital CMOS standard cell. In this known standard cell, analog/digital functional elements are connected by two fixed wiring planes.

SUMMARY OF THE INVENTION

Taking as a basis this prior art, it is therefore the object of the present invention to provide a configurable, analog and digital array by means of which a complete system including analog and, if desired, digital basic elements can be configured by the user without any substantial restrictions. This object is achieved by a configurable array, comprising at least two first-order matrix arrays comprising a plurality of basic elements which are arranged in rows and/or columns, and including each a first switch matrix; and at least one second-order matrix array including a second switch matrix which connects the at least two first-order matrix arrays; wherein the basic elements are digital and at least partially analog basic elements; the first-order matrix arrays and the second-order matrix array are arranged on a common substrate;

the configurable array is provided with a device for inputting configuration data and for configuring the array;

the respective first switch matrix is adapted to be controlled by said device for inputting configuration data so as to interconnect the signal inputs and/or the signal outputs of the basic elements and so as to connect the basic elements to matrix inputs and/or matrix outputs of the first-order matrix array;

the second switch matrix is directly connected to the array inputs and array outputs and is adapted to be controlled by said device for inputting configuration data so as to interconnect the matrix inputs and/or the matrix outputs of the first-order matrix arrays and so as connect the matrix inputs and the matrix outputs of the first-order matrix arrays to array inputs and array outputs.

The configurable analog and digital array according to the present invention comprises a hierarchical structure with at least two first-order matrix arrays and at least one second-order matrix array.

Each of said first-order matrix arrays includes a plurality of basic elements, which are arranged in rows and/or columns and at least part of which are analog basic elements, and a first switch matrix for controllably interconnecting the signal inputs and/or the signal outputs of the basic elements and for controllably connecting said basic elements to matrix inputs and/or matrix outputs of said first-order matrix array. The second-order matrix array comprises a second switch matrix for controllably interconnecting the matrix inputs and/or the matrix outputs of the first-order matrix array and for controllably connecting said first-order matrix array to array inputs and/or array outputs.

The system defined in this way can comprise controllable analog and digital functional blocks of different architectures and degrees of complexity in the form of an integrated circuit on a common substrate in such a way that the submodules and basic elements provided can flexibly and reversibly be interconnected and configured such that they define a complete system which is used for mixed analog/digital signal processing and which can arbitrarily be predefined to a large extent. Hence, this system defines a "construction set" comprising a certain fundamental amount of basic elements in the form of analog and digital blocks, which are parameterizable and, consequently, modifiable and which can, within certain limits, be interconnected and configured such that a complete system is obtained.

Preferably, the basic elements have an analog and/or digital control input in addition to their signal input and their signal output. Hence, certain properties of said basic elements can be varied, i.e. parameter values can be set, within predetermined limits. The signals for the analog and digital control input of a basic element are programmed into storage elements, which are adapted to be written to, read from and erased and which serve as parametrization registers and are located directly on said basic elements, and in said storage elements they can be reset and erased at any time. If, for example, a basic element in the form of an amplifier is provided, properties such as the gain, the bandwidth, the power loss, the offset etc. of said amplifier can be adjusted according to requirements.

A first-order matrix array can include, if desired, a multiplying digital/analog converter which can have supplied thereto a binary data word from such a parametrization register so that said digital/analog converter will generate on the output side an analog control signal by means of which the analog control input of the basic element can be controlled.

In the present embodiment, the basic elements are configured into a complete system by controlling the analog and digital control inputs of the basic element and by controlling switches of said first and second matrix arrays via the matrix inputs and the array inputs.

In accordance with a preferred embodiment, a shift register is provided into which the data for the configuration can be read serially and which defines the parametrization register.

In accordance with a deviating embodiment, a parallel interface can be provided, which permits parallel input of the configuration data into the array. In any case, a host computer for generating the configuration data can be used for producing the control data.

In a more advanced realization, it is also possible to provide a microcontroller on a chip, which carries out the routing (setting of the configuration registers); in the course of this process, it evaluates information supplied from outside, e.g. in the form of a netlist. This can also be stored temporarily in a separate region (RAM, EPROM or the like).

Between the basic elements as well as between the first-order matrix arrays, which are defined by said basic elements, a large number of switchable connections is provided, said switchable connections permitting a largely arbitrary wiring between the individual basic elements. In view of the fact that the input lines as well as the output lines of the basic elements are guided within said matrix-shaped arrays, it is also possible to form a feedback structure of basic elements within the first-order matrix array.

The first-order circuit array defined by the basic elements within the first-order matrix array can be composed by means of the second- or higher-order matrix array so as to form a complete system which can practically be selected without any substantial restrictions.

The hierarchical structure of the configurable array according to the present invention, which consists of first-order matrix arrays and of at least one second-order matrix array, permits a testability of the individual basic elements as well as a testability of the configured system by means of measures which are, in principle, normally used in the field of digital configurable arrays. In digital structures, all combinatorial logic functions are carried out as minimalized functions for this purpose and, consequently, they are completely testable. The combinatorial basic logic elements have provided between them registers which are interconnected by a scan path. Furthermore, programmable signature registers and a boundary-scan path may be provided.

In analog structures, the observability of special internal nodes of the complete system is provided. This can be done e.g. by means of decoupling elements (e.g. amplifiers), which are adapted to be additionally connected and which can, in turn, selectively be switched onto an output pin or an analog basic element. These measures are taken for achieving an essentially load-free measurement for the network node. The array structure according to the present invention also permits the separability of certain connections within the module as well as the settability of internal nodes via chip-external inputs or outputs of the module. The variable configurability of the array according to the present invention permits the configuration of test systems which carry out an on-chip test and which, in an adequate constellation, examine the operability of the complete system to a largely exhaustive extent. Such self-checking systems may also have incorporated therein mixed analog/digital components.

According to a special feature of the present invention, at least some of the basic elements have a qualification register associated with each of them, said qualification register being constructed as a read-write memory or as a read-only memory and containing at least one information on the total failure of the basic element and, optionally, information on operating characteristics of the basic element. This embodiment of the array according to the present invention permits, subsequent to the function test, an extraction of component and circuit parameters for each individual chip, on which the array is implemented, by means of special configuration measures. The results of this parameter extraction are then incorporated into parameterizable functional macro models and they will be used in all future simulations. A scattering of the parameters of the respective components and circuits caused by process variations can thus individually be compensated for to a large extent by adaptation of the simulation environment. A characterization plan for specific switching properties can then be prepared for each chip, said characterization plan being used by the configuration software as a basis for a qualification of each part of the circuit for specific tasks. For this purpose, an unequivocal identification code can be stored on each chip. This can, for example, be in the form of a PROM region which can be burnt by the user, i.e. written as a read-only memory.

By associating one qualification register with each of the basic elements, information on the operability of the basic elements can be stored. As has already been mentioned, such a qualification within the qualification register includes e.g. the information on the total failure of the basic element or features which are indicative of other properties. This information can, on the one hand, be ascertained by the manufacturer during testing and it can be made available in qualification registers so that the chip yield can be improved. In view of the fact that each type of module exists several times on the chip, sufficient redundancy is provided. On the other hand, the qualification can also be carried out by the user at any time. This will permit a flexible qualification depending on the respective case of use. However, this method also allows to localize failures occurring during operation, and it allows to mark said failures and to circumvent them by a reconfiguration of the system; in so doing, all qualification registers should be taken into account. This aspect increases the reliability of the system, since the system can be "repaired" on site without interfering with the hardware.

In accordance with a special aspect of the present invention, the elements which are not statically loss-free, such as amplifiers, interface circuits etc., can be separated from the operating voltage via a power disconnection input. This embodiment permits unused or faulty basic elements to be disabled, whereby the power loss of the complete system will be reduced. Taking into account the fact that, in many cases, only a small part of the basic elements of such an array is used for the configuration of a certain user-specific circuit, this aspect can be very important. Such an input can, of course, also be controlled in specific time slots during operation for limiting the power loss. Also for the purpose of disabling a basic element, a separate storage element within the basic element is preferably used, said storage element being adapted to be programmed separately.

The array according to the present invention provides adaptive systems. The configured system is able to provide output signals which modify the system itself in a specific manner, i.e. which automatically reconfigure the system. This can be done e.g. by modifying the programmable wiring or by modifying the properties of the modules. On the basis of a suitable structural design, the arrays can be modified in real time operation.

The array according to the present invention is preferably implemented in BICMOS technology. This technology is particularly suitable, since, on the one hand, it is capable of carrying out sophisticated analog functions on the basis of bipolar components and since, on the other hand, it permits very large scale integration due to low-loss CMOS technology. Furthermore, due to the flexible interconnection concept, good driver properties are demanded; the driver must flexibly respond to the load capacities. However, a solution in CMOS technology or in a different technology suitable for large scale integration is, in principle, imaginable as well.

The transfer of a prototype, which has been configured on the array according to the present invention, to an optimized circuit for larger numbers of parts can easily be contrived by combining in a suitable CAD environement the data, which have been ascertained during the configuration, with the analog and digital library elements so as to obtain the desired complete system; in the course of this process, unused elements are omitted and additional units used for the wiring and the programmability, such a multiplexers and registers, are replaced by fixed wiring. In view of the fact that the complete system had already been simulated fully within the configurable modular array according to the present invention, the problem of a transition to other modules does not arise when the technology according to the present invention is used.

The analog basic elements of the array according to the present invention comprise e.g. integrators, comparators, amplifiers, phase detectors and adjustable references. The adjustable references can be realized by multiplying digital/analog converters.

BRIEF DESCRIPTION OF THE DRAWINGS

In the following, preferred embodiments of the configurable, analog and digital array according to the present invention will be explained in detail with reference to the drawings enclosed, in which.

DESCRIPTION OF THE PREFERRED EMBODIMENTS OF THE INVENTION

Figure 1:
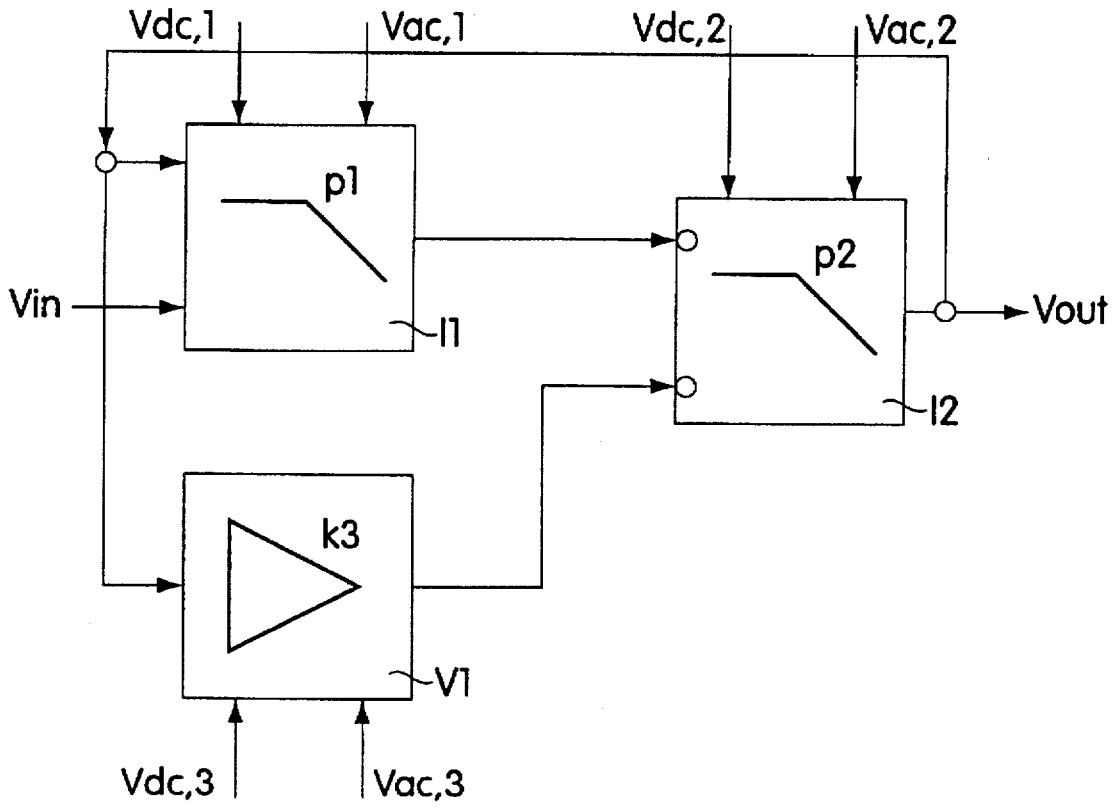
FIG. 1 shows a second-order loop filter defined by basic elements within the first-order matrix array.

FIG. 1 shows a first possible structuring within a first level of the array according to the present invention, said level being defined by a first-order matrix array, as will be explained in detail hereinbelow. The designation first level is used in the present connection in view of the fact that, within this level, only a configuration of basic elements I1, I2, V1 is provided. The configuration shown in the present figure comprises two integrators I1, I2 or first-order lowpass filters, which are adapted to be controlled in a digital fashion for coarse adjustment as well as in an analog fashion for fine adjustment, and an amplifier V1 which is controllable as well. Reference numerals Vdc; Vac stand for digital and analog control inputs.

Figure 2:
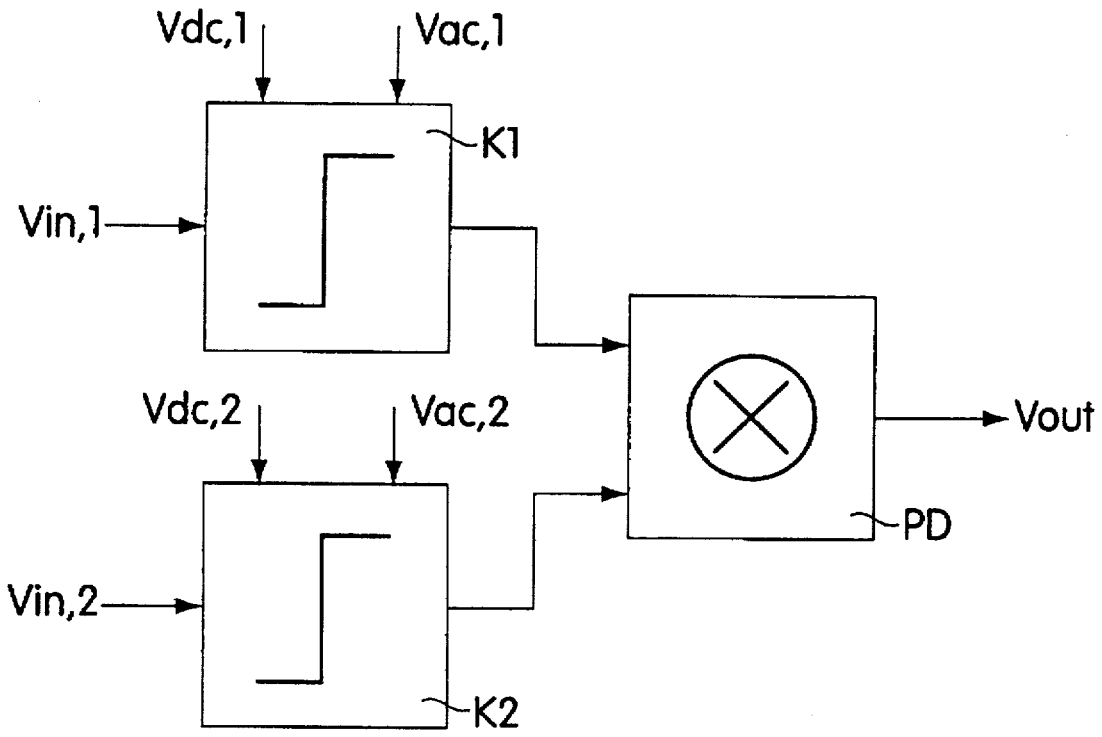
FIG. 2 shows a phase detector defined by basic elements within the first-order matrix array.

FIG. 2 shows an additional first level of the array according to the present invention, i.e. also a subconfiguration of basic elements which is defined by a first-order matrix array. In this exemplary circuit, two voltage comparators K1, K2 are provided, which are followed by a phase detector PD.

Figure 3:
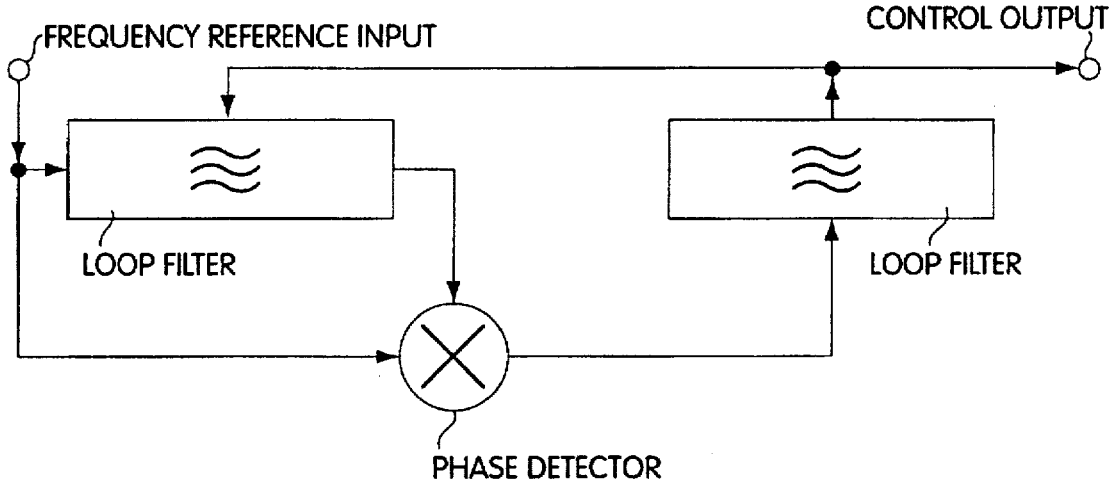
FIG. 3 shows a frequency-locked loop (FLL) defined by the circuits according to FIGS. 1 and 2 by means of the second-order matrix array.

FIG. 3 shows the block diagram of an FLL (frequency-locked loop). This circuit consists of three blocks, which are each formed on the first level of the digital array according to the present invention, as can clearly be seen in FIGS. 1 and 2. Hence, the circuit shown in FIG. 3 can be referred to as circuit of the second level. This representation according to FIG. 3 clearly shows the hierarchical structure of the analog/digital design of the whole array according to the present invention. Macros of the first level are formed on the basis of basic elements, and these macros can, in turn, configure a system of the second level, this being also possible in cooperation with basic elements of the lower levels.

The embodiment shown in the present connection is structured over two levels. To the person skilled in the art it will be obvious that the concept of a hierarchical array according to the present invention can be realized over several levels.

Figure 4:
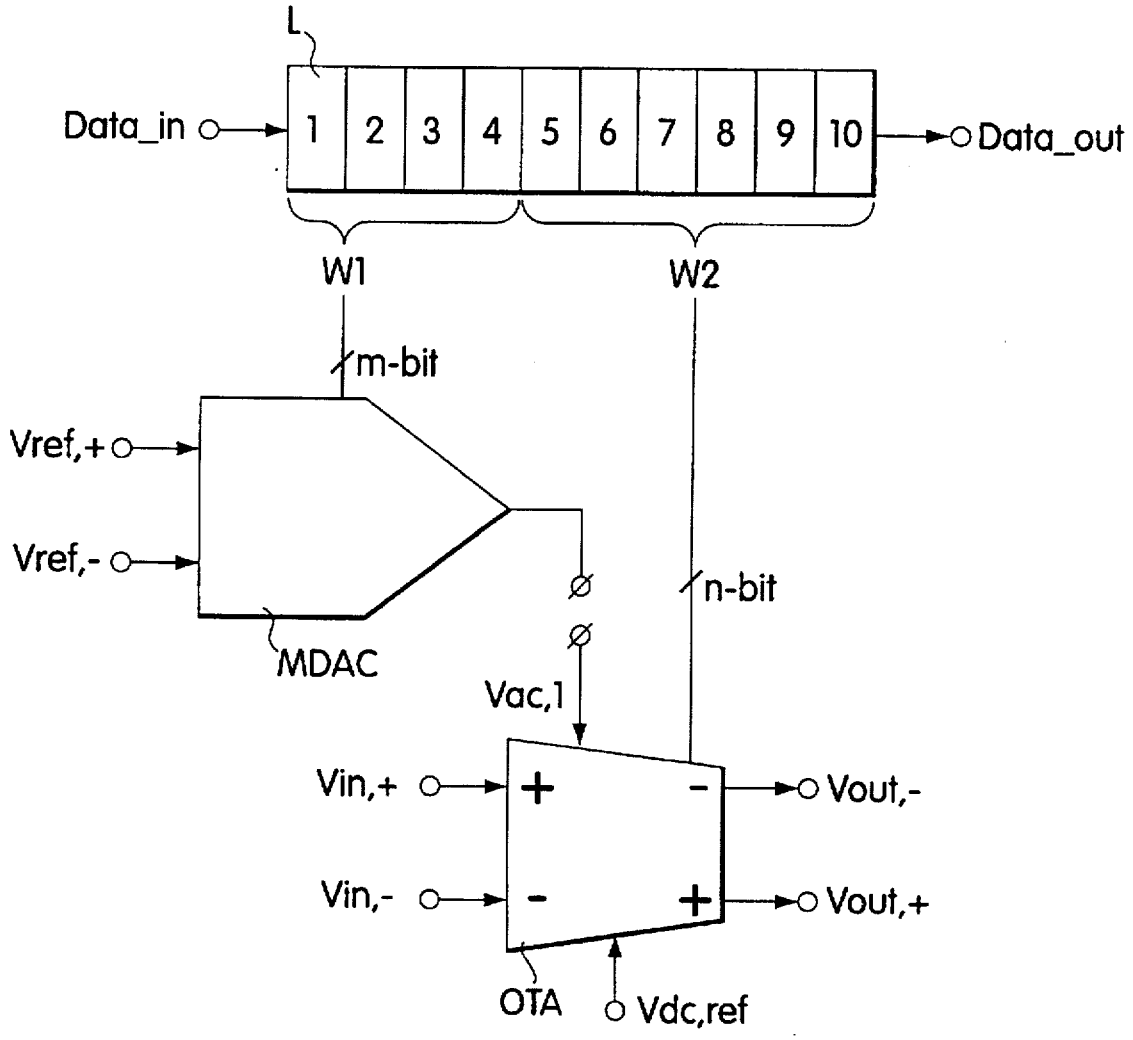
FIG. 4 shows a controllable transconductance operational amplifier.

FIG. 4 shows the circuit architecture of a programmable, controllable transconductance operational amplifier OTA in differential path technique. As a representative example for the other basic elements, this structure is intended to elucidate, in principle, the control possibilities of a basic element. The digital adjustment is a coarse adjustment. This coarse adjustment is carried out by means of the data word W2. The fine adjustment takes as a basis the data word W1 and is carried out via a programmable, multiplying digital/analog converter MDAC; such analog control voltages can also be provided externally. A 10-bit latch L is used for digital programming for the purpose of coarse adjustment as well as for the purpose of fine adjustment. These latches L are included in the BBB rows/lines of the basic elements, which are shown in FIG. 5 and which will be described in detail hereinbelow making reference to FIG. 5.

As can be seen from this figure, the analog fine adjustment of the basic elements (BBB=basic building block) can be carried out either by multiplication of the analog/digital converters with the aid of the binary data word W1 or by an external analog control voltage (external or adaptive control). Both methods influence primarily the transconductance.

The digital control effects a digital coarse adjustment by additionally connecting or disconnecting prefabricated current and voltage references within the first-order matrix arrays via the data word W2. In this way, it is, for example, also possible to keep the transconductance programmable. In addition, references can be scaled for dynamic adaptation.

Figure 5:
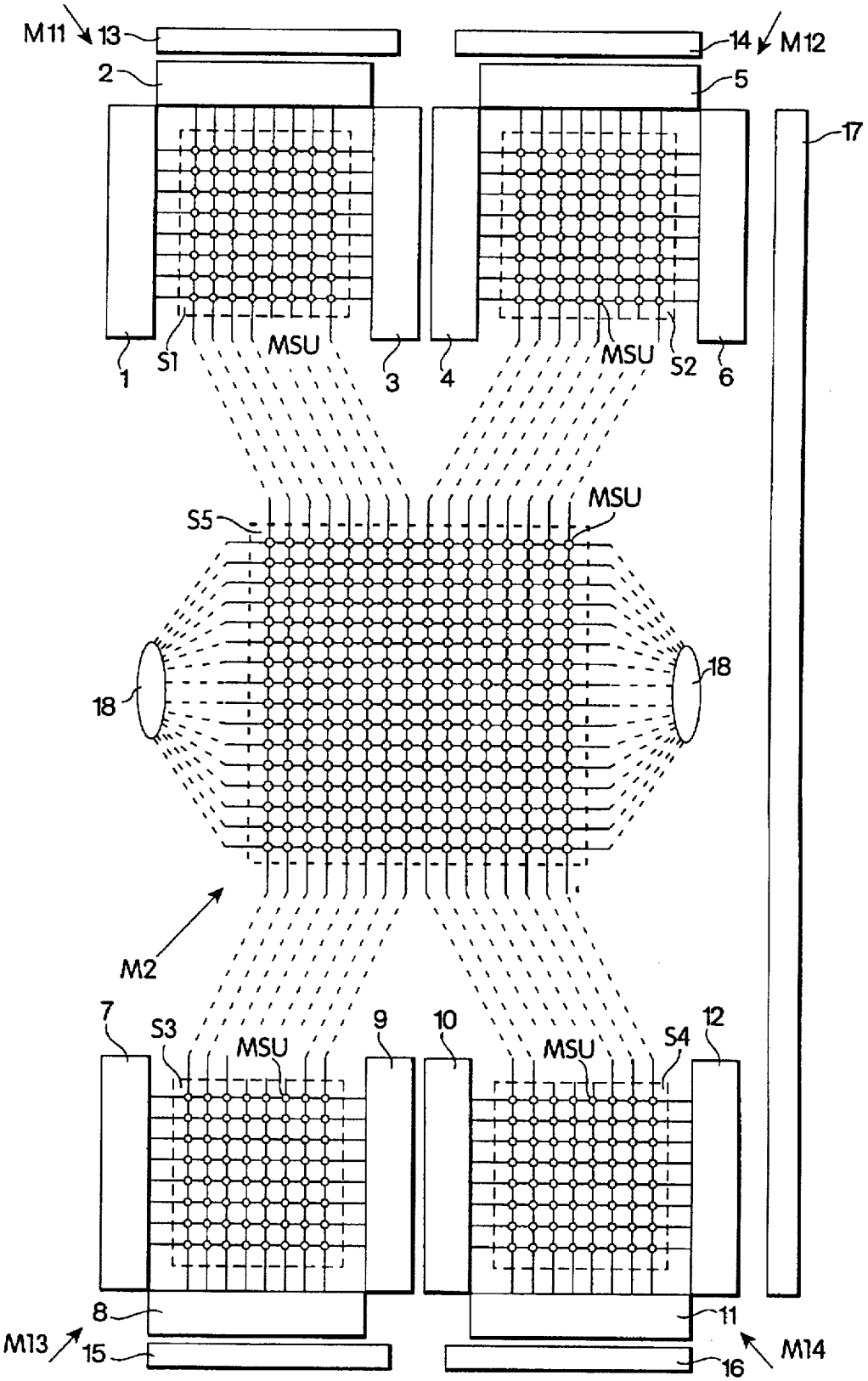
FIG. 5 shows a minimum embodiment of an array according to the present invention.

As can be seen in FIG. 5, the embodiment shown in said figure comprises a configurable analog and digital array arrangement according to the present invention, four first-order matrix arrays $M_{11}$, $M_{12}$, $M_{13}$, $M_{14}$ and a second-order matrix array $M_2$. Each first-order matrix array $M_{11}$, $M_{12}$, $M_{13}$, $M_{14}$ comprises a plurality of basic elements BBB, which are shown in said FIG. 5 as BBB rows/lines 1 to 12. The basic elements are connected within the matrix arrays $M_{11}$, $M_{12}$, $M_{13}$, $M_{14}$ by means of first switch matrixes $S_1$ to $S_4$, which can be (8×8) switch matrixes in the case of the example shown. The networking logic in connection with the switch matrix units MSU permits crossing-free interconnections, which are individually programmable via $m^2$-bit long shift registers 13 to 16 for the first-order matrix arrays (m=number of crossing-free interconnections). In order to increase the number of basic elements grouped round the matrix without providing any additional connection paths, decodable line selectors may be used at the peripheral equipment, said line selectors being capable of disconnecting and/or connecting incoming or outgoing signal/supply paths. All external connections of the matrix can be programmed as inputs or outputs or as bidirectional connections. Multiplexers in the selectors permit a variable signal/supply configuration.

In order to achieve the greatest possible variety in programming the signal/supply paths, two different elementary networking conditions, viz. crossing and interconnection, can primarily be realized. When a crossing point MSU is being programmed, a conductive, bidirectional connection is established between a horizontal and a vertical line segment. Further crossing points MSU can additionally be connected to these segments so that also line segments extending in parallel can be realized. If the selectors at the matrix borders are deactivated, these line segments will end at the matrix periphery. The switch matrixes are all shown without any separation units. Unless shown in a different manner, the respective signal paths end at the matrix periphery in the structures shown.

As can again be seen in FIG. 5, the second-order matrix array $M_2$ defines together with the first-order matrix arrays $M_{11}$, $M_{12}$, $M_{13}$, $M_{14}$ in said FIG. 5 a configurable, digital array with two levels. The second-order matrix array $M_2$ also comprises a switch matrix which is a (16×16) switch matrix in the embodiment shown in the present connection. The vertical signal lines of this matrix are the input and output lines of the switch matrixes $S_1$ to $S_4$ of the first-order matrix array. Horizontal lines of the switch matrix of the second-order matrix array are defined by outputs of a 256-bit shift register 17 as well as by array input and array output lines. The latter define an interface 18 for the array.

The switch matrixes $S_1$ to $S_5$ consist of 1-bit switches and 1-bit memories, which are arranged in the form of a field. By setting a "1" or a "0", the signal and/or supply paths can be connected and disconnected, respectively.

Figure 6:
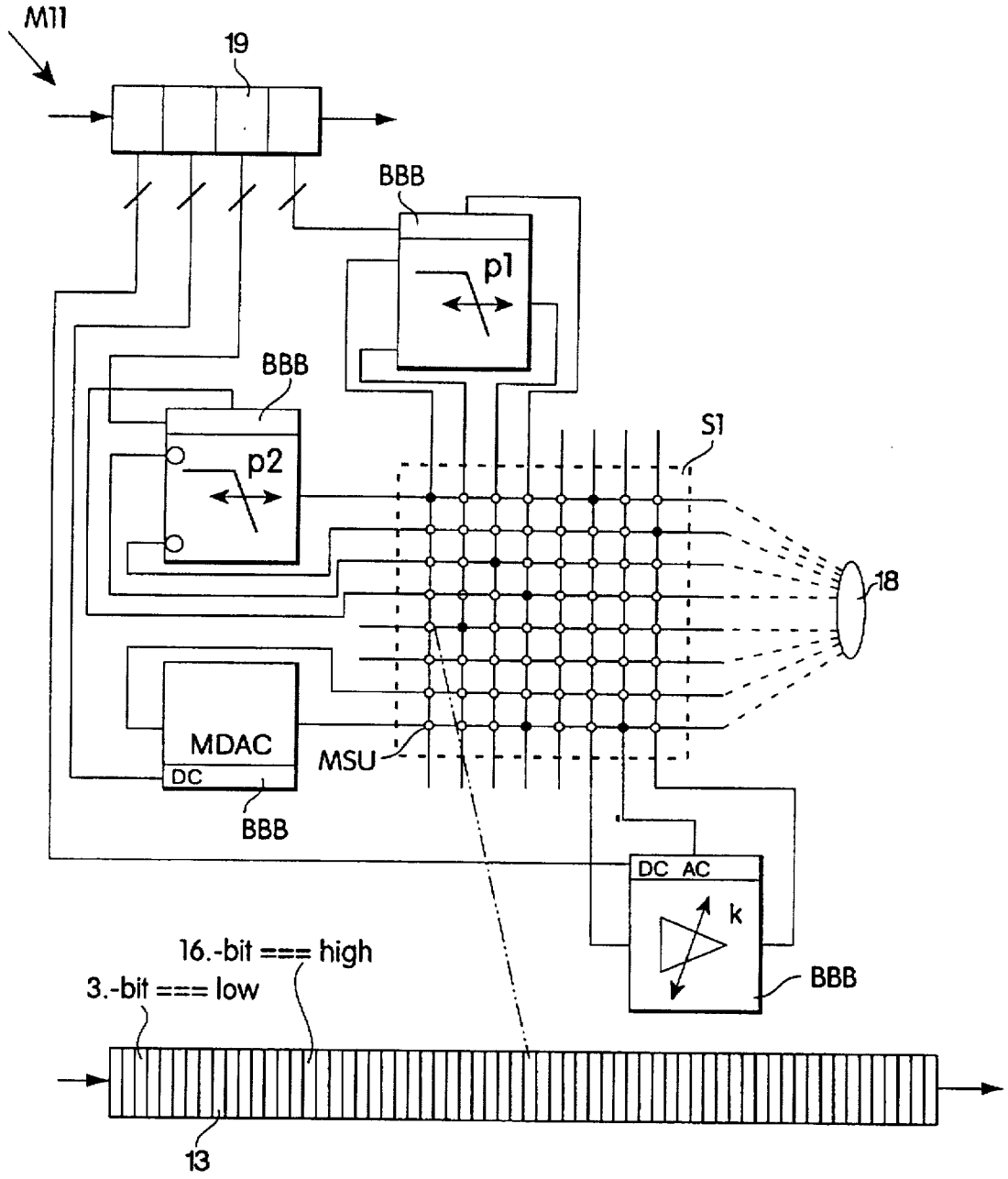
FIG. 6 shows a representation of a second-order loop filter defined by the first-order matrix array of the array according to the present invention.

FIG. 6 shows the realization of the loop filter according to FIG. 1 by a first-order matrix array $M_{11}$ in the first level of the array. Circuit elements designated by like reference numerals represent identical components in all the figures so that the function and the structure of said circuit elements need not be explained again. As can easily be seen from said FIG. 6, specific basic elements are selected from the BBB rows/lines 1, 2, 3 by the configuration which is predetermined by the content of the shift register 13, whereupon they are interconnected in the desired manner. Said FIG. 6 also shows in a particularly clear manner the function of the 64-bit shift register 13 for the analog configuration as well as the function of the 16-bit shift register 19 for the digital coarse control.

Figure 7:
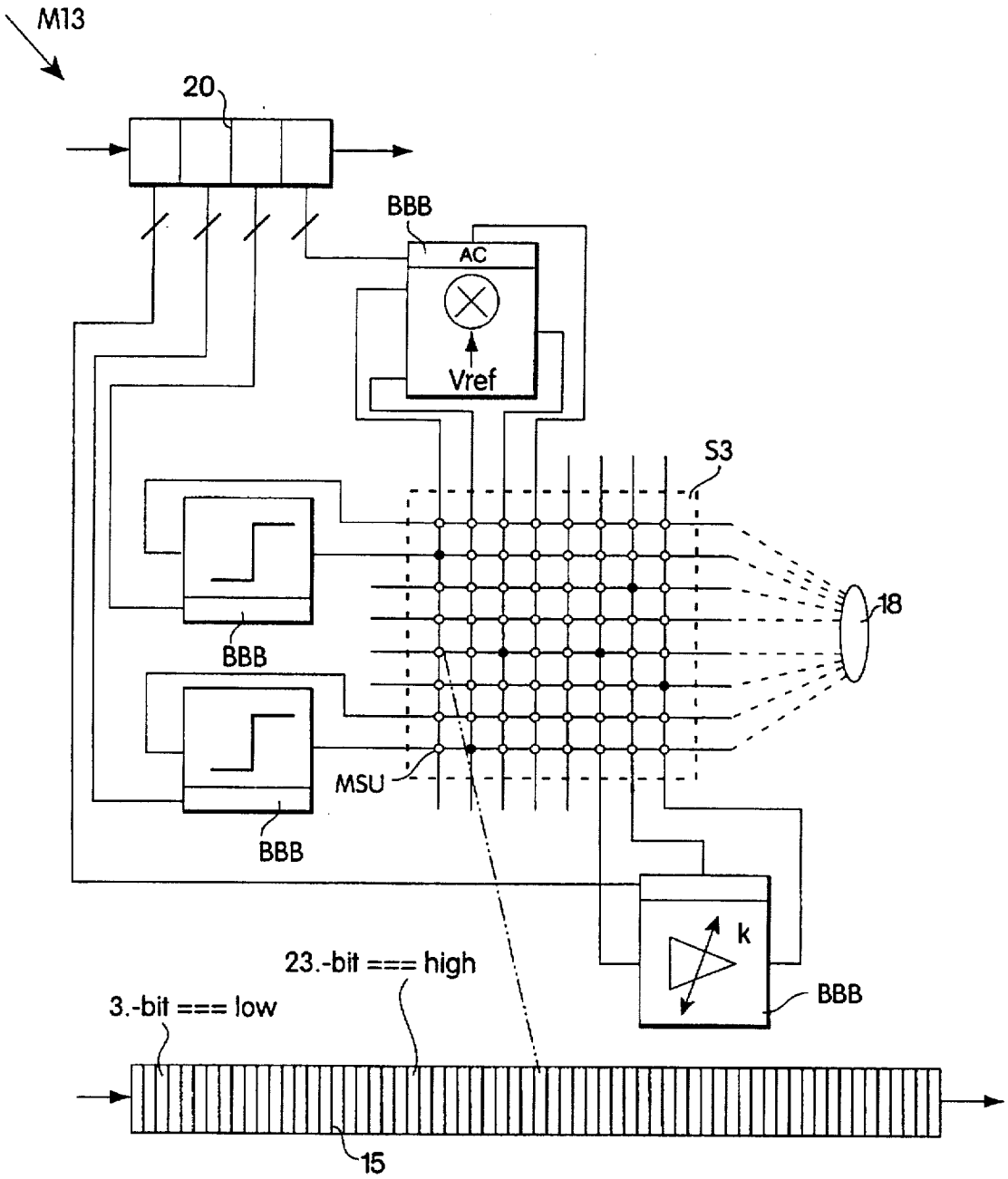
FIG. 7 shows a phase detector defined by the first-order matrix array of the array according to the present invention.

FIG. 7 shows a representation of a phase detector with two voltage comparators, realized by means of the third first-order matrix array $M_{13}$, said representation corresponding to the representation shown in FIG. 2. In this case, too, the 64-bit shift register 15 is used for the analog configuration, whereas the 16-bit shift register 20 is used for the digital coarse control.

Figure 8:
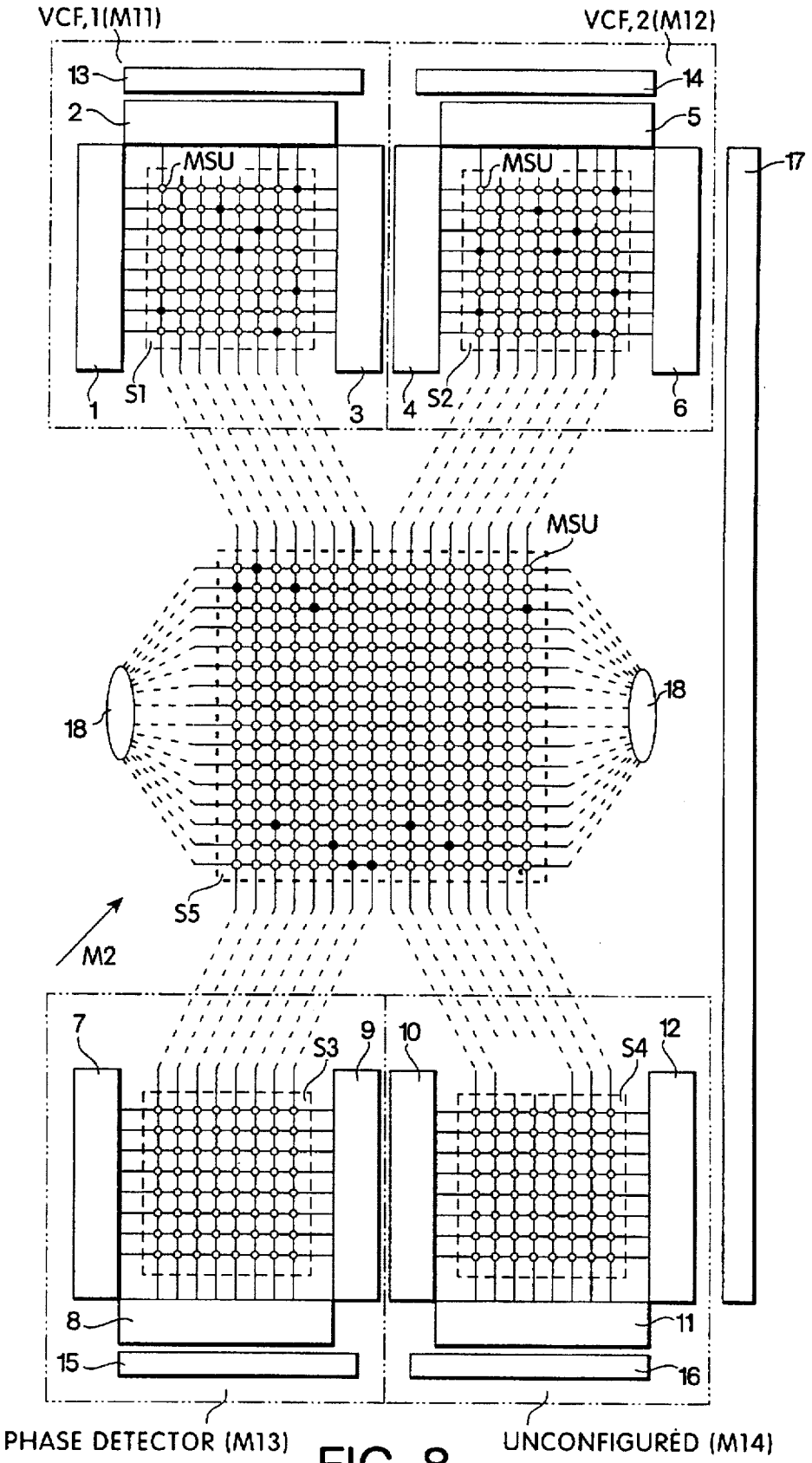
FIG. 8 shows a representation of the array according to the present invention when said array is programmed as a frequency-locked loop, said representation corresponding to the representation shown in FIG. 5.

FIG. 8 shows the whole wiring network, which is defined by the array according to FIG. 5, for implementing the frequency-locked loop according to FIG. 3 in the second level of the array. In view of the fact that the individual components have been explained with reference to the preceding figures, a renewed explanation of the individual matrix arrays can be dispensed with.

We claim:

1. A configurable array, comprising at least two first-order matrix arrays comprising a plurality of basic elements which are arranged in rows and/or columns, and including each a first switch matrix; and at least one second-order matrix array including a second switch matrix which connects the at least two first-order matrix arrays; wherein the basic elements are digital and at least partially analog basic elements;

the first-order matrix arrays and the second-order matrix array are arranged on a common substrate;

the configurable array is provided with a device for inputting configuration data and for configuring the array;

the respective first switch matrix is adapted to be controlled by said device for inputting configuration data so as to interconnect the signal inputs and/or the signal outputs of the basic elements and so as to connect the basic elements to matrix inputs and/or matrix outputs of the first-order matrix array;

the second switch matrix is directly connected to the array inputs and array outputs and is adapted to be controlled by said device for inputting configuration data so as to interconnect the matrix inputs and/or the matrix outputs of the first-order matrix arrays and so as connect the matrix inputs and the matrix outputs of the first-order matrix arrays to array inputs and array outputs.

2. An array according to claim 1, wherein the basic elements additionally have an analog and/or digital control input.

3. An array according to claim 2, wherein each first-order matrix array includes a parametrization register containing digital control signals for the digital control inputs of the basic elements as well as control bits for the switches.

4. An array according to claim 2, wherein each first-order matrix array includes a multiplying digital/analog converter which is acted upon by a binary data word from a parametrization register for generating an analog control signal for the analog control input of the basic element.

5. An array according to claim 2, wherein the basic elements are configured into a complete system by controlling the analog and digital control inputs of said basic elements an by controlling the switches of said first and second matrix arrays via the matrix inputs and the array inputs.

6. An array according to claim 5, wherein a shift register is provided into which data for the configuration can be read serially and which defines the parametrization register.

7. An array according to claim 5, wherein a parallel interface is provided, which permits parallel input of the configuration data into the array.

8. An array according to claim 1, wherein at least some of the basic elements have each a qualification register associated with each of them, said qualification register being constructed as a read-write memory or as a read-only memory and containing at least one information on the total failure of the basic element.

9. An array according to claim 8, wherein the qualification register additionally contains information on operating characteristics of the basic element.

10. An array according to claim 1, wherein at least the basic elements which are not statically loss-free can be separated from the operating voltage via a power disconnection input.

11. An array according to claim 1, wherein the array is implemented in BICMOS technology.

12. An array according to claim 1, wherein the analog basic elements comprise at least one of the following components:

integrators, comparators, amplifiers, phase detectors and adjustable references.

13. An array according to claim 12, wherein the adjustable references consist of multiplying digital/analog converters.

14. An array according to claim 1, wherein the first switch matrix and the second switch matrix consist of a plurality of 1-bit switches and 1-bit memories arranged in the form of a matrix.

* * * * *